US008900015B2

(12) United States Patent
Yuan et al.

(10) Patent No.: US 8,900,015 B2
(45) Date of Patent: Dec. 2, 2014

(54) COMMUNICATION CONNECTOR WITH REDUCED CROSSTALK

(71) Applicant: Panduit Corp., Tinley Park, IL (US)

(72) Inventors: Michael K. Yuan, Joliet, IL (US); Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 185 days.

(21) Appl. No.: 13/633,645

(22) Filed: Oct. 2, 2012

(65) Prior Publication Data

US 2013/0084755 A1 Apr. 4, 2013

Related U.S. Application Data

(60) Provisional application No. 61/542,323, filed on Oct. 3, 2011.

(51) Int. Cl.

| | |
|---|---|
| ***H01R 24/00*** | (2011.01) |
| ***H01R 24/64*** | (2011.01) |
| ***H01R 13/6473*** | (2011.01) |
| ***H01R 4/24*** | (2006.01) |
| ***H01R 13/6461*** | (2011.01) |
| *H01R 107/00* | (2006.01) |

(52) U.S. Cl.

CPC ..... *H01R 24/64* (2013.01); *H01R 2107/00* (2013.01); *H01R 13/6473* (2013.01); *H01R 4/242* (2013.01); *H01R 13/6461* (2013.01)

USPC ..... 439/676

(58) Field of Classification Search

CPC ..... H01R 23/025; H01R 23/005; H01R 13/6658; H05K 1/0228; H05K 2201/10189

USPC ..... 439/676, 404

See application file for complete search history.

(56) References Cited

U.S. PATENT DOCUMENTS

| | | | | |
|---|---|---|---|---|
| 4,256,393 | A * | 3/1981 | Dietrich et al. | 396/198 |
| 4,268,147 | A * | 5/1981 | Date et al. | 396/195 |
| 6,749,466 | B1 * | 6/2004 | Milner et al. | 439/676 |
| 6,923,672 | B1 * | 8/2005 | Chen | 439/404 |
| 6,979,222 | B2 * | 12/2005 | Comini | 439/404 |
| 6,994,594 | B2 * | 2/2006 | Milner et al. | 439/676 |
| 7,294,025 | B1 * | 11/2007 | Chen | 439/676 |
| 7,452,245 | B2 | 11/2008 | Doorhy et al. | |
| 7,856,709 | B2 * | 12/2010 | Bresche et al. | 29/847 |
| 7,857,635 | B2 * | 12/2010 | Goodrich et al. | 439/76.1 |
| 7,914,345 | B2 * | 3/2011 | Bopp et al. | 439/676 |
| 7,922,515 | B2 * | 4/2011 | Fitzpatrick et al. | 439/404 |
| 7,927,152 | B2 * | 4/2011 | Pepe et al. | 439/676 |
| 8,002,571 | B2 * | 8/2011 | Hogue et al. | 439/404 |

(Continued)

FOREIGN PATENT DOCUMENTS

| | | | |
|---|---|---|---|
| WO | 2007121581 | A1 | 11/2007 |
| WO | 2008109922 | A1 | 9/2008 |

*Primary Examiner* — Amy Cohen Johnson
*Assistant Examiner* — Vladimir Imas
(74) *Attorney, Agent, or Firm* — Christopher S. Clancy; Yuri Astvatsaturov

(57) ABSTRACT

A communication connector including a housing and a plurality of contact pairs arranged relative to the housing. One of the plurality of contact pairs includes a first conductor termination zone centerline, and another contact pair includes a second conductor termination zone centerline, wherein the second conductor termination zone centerline is an approximately perpendicular bisector of the first conductor termination zone centerline.

22 Claims, 12 Drawing Sheets

(56) References Cited

U.S. PATENT DOCUMENTS

| | | | | |
|---|---|---|---|---|
| 8,002,590 | B2 * | 8/2011 | Ciezak et al. | 439/676 |
| 8,007,311 | B2 * | 8/2011 | Hogue et al. | 439/404 |
| 8,075,347 | B2 * | 12/2011 | Hogue et al. | 439/676 |
| 8,100,727 | B2 * | 1/2012 | Murray et al. | 439/676 |
| 8,128,436 | B2 * | 3/2012 | Bopp et al. | 439/676 |
| 8,157,600 | B2 * | 4/2012 | Ciezak et al. | 439/676 |
| 8,313,338 | B2 * | 11/2012 | Hogue et al. | 439/404 |
| 8,413,323 | B2 * | 4/2013 | Bresche et al. | 29/847 |
| 8,425,260 | B2 * | 4/2013 | Seefried et al. | 439/676 |
| 8,435,078 | B2 * | 5/2013 | Hsueh | 439/660 |
| 8,573,116 | B2 * | 11/2013 | Etter et al. | 99/288 |
| 2007/0238366 | A1 | 10/2007 | Hammond, Jr. et al. | |
| 2009/0225979 | A1 | 9/2009 | Pelletier et al. | |
| 2010/0151707 | A1 * | 6/2010 | AbuGhazaleh et al. | 439/76.1 |
| 2010/0167578 | A1 * | 7/2010 | Houge et al. | 439/404 |
| 2011/0053430 | A1 * | 3/2011 | Bopp et al. | 439/676 |
| 2011/0250802 | A1 * | 10/2011 | Pepe et al. | 439/676 |
| 2011/0306250 | A1 * | 12/2011 | Bopp et al. | 439/676 |
| 2012/0034822 | A1 * | 2/2012 | Bopp et al. | 439/676 |
| 2012/0202389 | A1 * | 8/2012 | Erickson et al. | 439/676 |

* cited by examiner

COMMUNICATION CONNECTOR WITH REDUCED CROSSTALK

CROSS-REFERENCE TO RELATED APPLICATIONS

This application claims the benefit of U.S. Provisional Patent Application No. 61/542,323, filed on Oct. 3, 2011.

FIELD OF THE INVENTION

The present invention relates generally to a communication connector and, more particularly, to a communication jack with reduced alien and internal crosstalk.

BACKGROUND OF THE INVENTION

10GBASE-T is an Ethernet standard that typically transmits information over a Category 6A (CAT6A) cabling channel at a rate of 10 Gigabits per second (10 Gb/s). A single 10GBASE-T channel typically includes four lanes each made up of a twisted differential pair of wires, and each pair operating at about 2.5 Gb/s. A single lane experiences both internal (near-end crosstalk (NEXT) and far-end crosstalk (FEXT)) and external (alien NEXT (ANEXT) and alien FEXT (AFEXT)) noise. Internal noise refers to noise whose source exists within that channel on one of the 4 internal lanes. Alien crosstalk refers to noise from an adjacent channel coupling onto one or more of the 4 lanes. Channel NEXT, FEXT, ANEXT, and AFEXT are typically measured according to ANSI/TIA-568-C.2 as attenuation to crosstalk ratio (ACR), far-end (ACR-F), power sum alien NEXT (PSANEXT), and power sum alien ACR-F (PSAACR-F), respectively. While active equipment can cancel out some amount of internal noise, it typically does not provide cancellation of alien crosstalk. Given the relative close proximity of both cables and connectors in a typical data center application, and the lack of alien crosstalk countermeasures in active equipment such as switches and servers, alien crosstalk between neighboring channels is a major concern within data centers, particularly with 10GBASE-T Ethernet. This alien crosstalk (either near-end (ANEXT), or far-end (AFEXT)) can occur between neighboring cables or between neighboring connectors (such as RJ45 jacks) of different channels. Crosstalk between the connectors may occur within high density patch panels when the connectors are in close proximity to each other. Crosstalk among cables typically occurs when cables are bundled together.

US Patent Application Publication Nos. 2010/0116521 (Nordin, et al.), 2010/0224389 (Jenner et al.), and 2010/0282493 (Nordin et al.), all incorporated by reference as if fully set forth herein, describe cables with discontinuous foil wrapped around the four twisted pairs. These foils effectively reduce alien crosstalk that would occur between cables bundled together. Additionally, US Patent Application Publication No. 2010/0197162 (Straka, et al.), incorporated by reference as if fully set forth herein, describes a jack with a discontinuous metallic foil surrounding it. This metallic foil also helps to reduce alien crosstalk between neighboring connectors, particularly within high density patch panel applications.

One primary source of alien crosstalk between neighboring connectors without a metallic foil is alien coupling among the insulation displacement contacts (IDCs). One reason coupling can exist in this region is that the IDCs are relatively large metallic structures designed to easily facilitate termination of the wires of a cable. As relatively large metallic structures, IDCs can capacitively and inductively couple to each other, either within a jack (resulting in NEXT or FEXT) or to neighboring jacks, which may result in increased alien crosstalk. Therefore, there exists a need for a communication connector that allows for relative ease of termination to a communication cable, with reduced crosstalk, including alien crosstalk, between neighboring channels.

SUMMARY OF THE INVENTION

In one embodiment, the present invention comprises a communication connector including a housing, and a plurality of contact pairs, where the plurality of contact pairs have a first contact pair and a second contact pair. The first contact pair have a first contact with a first conductor termination zone and a second contact with a second conductor termination zone, where the first conductor termination zone and the second conductor termination zone are staggered with respect to each other and define a first conductor termination zone centerline. The second contact pair having a third contact with a third conductor termination zone and a fourth contact with a fourth conductor termination zone, where the third conductor termination zone and the fourth conductor termination zone are staggered with respect to each other and define a second conductor termination zone centerline. Wherein the second conductor termination zone centerline is an approximately perpendicular bisector of the first conductor termination zone centerline.

In another embodiment, the present invention comprises a communication system including communication equipment, and a communication connector connected to the communication equipment, where the communication connector includes a housing and a plurality of contact pairs, the plurality of contact pairs having a first contact pair and a second contact pair. The first contact pair having a first contact with a first conductor termination zone and a second contact with a second conductor termination zone, where the first conductor termination zone and the second conductor termination zone are staggered with respect to each other and define a first conductor termination zone centerline. The second contact pair having a third contact with a third conductor termination zone and a fourth contact with a fourth conductor termination zone, where the third conductor termination zone and the fourth conductor termination zone are staggered with respect to each other and define a second conductor termination zone centerline. Wherein the second conductor termination zone centerline is an approximately perpendicular bisector of the first conductor termination zone centerline.

In yet another embodiment, the present invention comprises a communication connector including a housing, and a plurality of contact pairs arranged relative to the housing, where at least one of the plurality of contact pairs includes a first contact with a first conductor termination zone and a second contact with a second conductor termination zone, the first conductor termination zone being offset from the second conductor termination zone to provide clearance for conductors to be terminated in the first and second contact, the first contact and the second contact configured for approximately maintaining a predetermined impedance.

In yet another embodiment, the present invention comprises a communication connector for interfacing with a communication cable having a plurality of communication wires arranged in communication wire pairs, the communication connector comprising a plurality of contact pairs, each of the plurality of contact pairs including a first generally planar contact having a first termination slot for terminating a corresponding one of the communication wires and a second generally planar contact having a second generally planar slot for terminating a corresponding another one of the communication wires. Wherein the first termination slot and the second termination slot are staggered with respect to each other, and wherein for each contact pair within the connector, there exists an adjacent contact pair within the connector in which the termination slots of the contacts in the adjacent contact pair are equidistant from the termination slot of at least one of the contacts in the contact pair.

In yet another embodiment, the present invention is a method of connecting a twisted pair conductor communication cable to a communication jack, where the method comprises the steps of providing a communication jack having a housing and a plurality of contact pairs, positioning one of said plurality of contact pairs which defines a first conductor termination zone centerline, and another of said plurality of contact pairs which defines a second conductor termination zone centerline, wherein the one of said plurality of contact pairs includes a first pair of contacts which are staggered with respect to each other and the another of said plurality of contact pairs includes a second pair of contacts which are staggered with respect to each other, and wherein the second conductor termination zone centerline is an approximately perpendicular bisector of said first conductor termination zone centerline, and terminating the conductors of the twisted pair communication cable to respective plurality of contact pairs.

In still yet another embodiment, the present invention is a method of connecting a communication cable to a communication jack, wherein the communication cable has a plurality of communication wire pairs and wherein the communication jack has a housing and a plurality of contact pairs, the method comprises the steps of arranging the contact pairs relative to the housing so that contacts of each respective pair are staggered with respect to one another, and so that each contact pair is adjacent to another contact pair in which at least one of the contacts in the contact pair is equi-distant to both contacts in the adjacent contact pair, positioning the communication cable in the housing so that each of the plurality of communication wire pairs is associated with a corresponding one of each of the plurality of contact pairs, and terminating the communication wire pairs in the contact pairs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF AN ILLUSTRATED EMBODIMENT OF THE INVENTION

Figure 1:
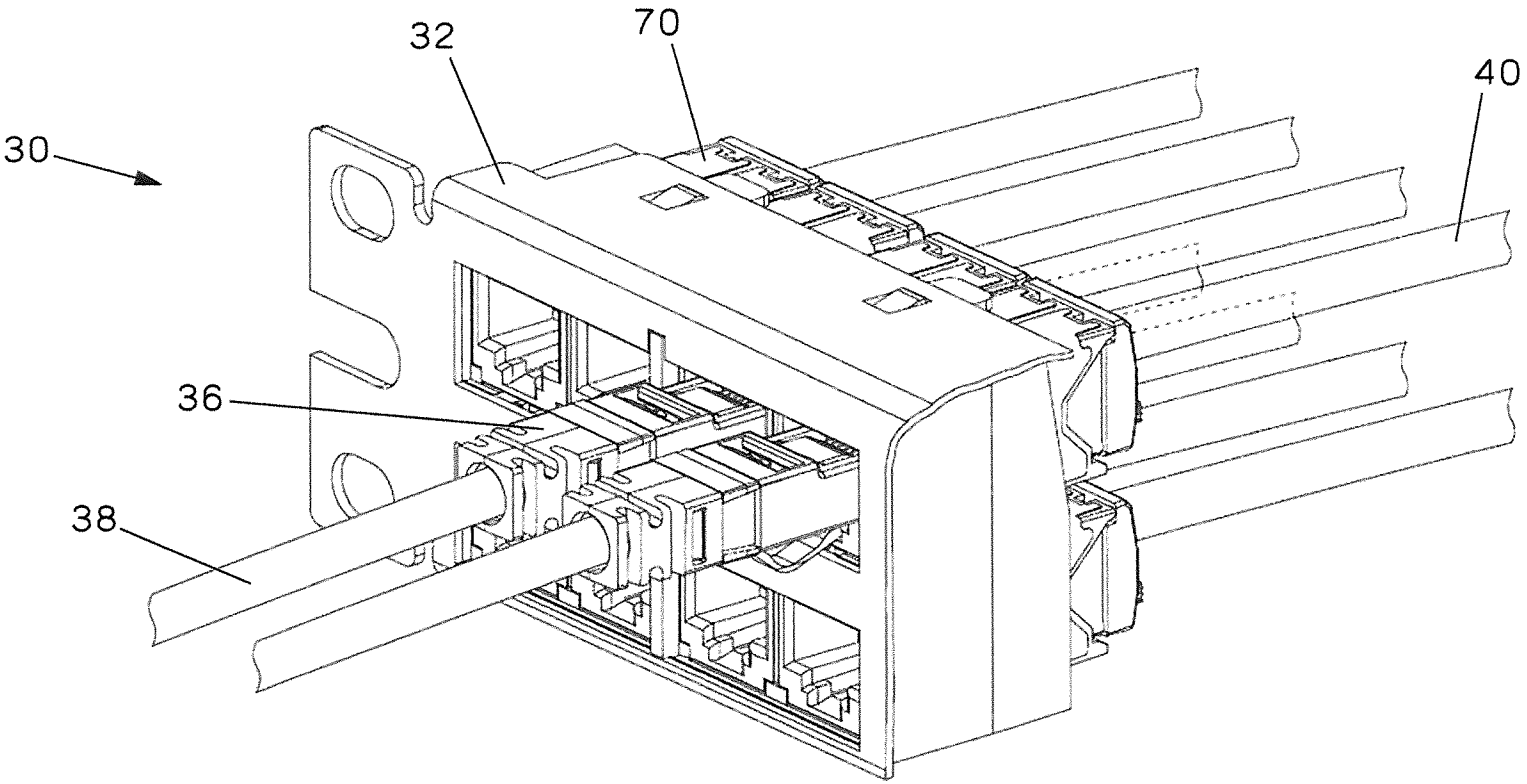
FIG. 1 is a perspective view of an embodiment of a communication system according to the present invention.

FIG. 1 illustrates a typical communication system 30 according to an embodiment of the present invention. The system 30 includes a patch panel 32 with jacks 70 and corresponding plugs 36. Respective cables 40 are terminated to jacks 70, and respective cables 38 are terminated to plugs 36. Once a plug 36 mates with a corresponding jack 70, data can flow in both directions through these connectors. Although communication system 30 is illustrated as including a patch panel in FIG. 1, it can alternatively include other active or passive equipment. Examples of passive equipment include, but are not limited to, modular patch panels, punch-down patch panels, coupler patch panels, and wall jacks. Examples of active equipment include, but are not limited to, Ethernet switches, routers, servers, physical layer management systems, and power-over-Ethernet equipment, as can be found in data centers and/or telecommunications rooms; security devices (cameras and other sensors, etc.) and door access equipment; and telephones, computers, fax machines, printers and other peripherals, as can be found in workstation areas. Communication system 30 can further include cabinets, racks, cable management and overhead routing systems, and other such equipment.

Figure 2:
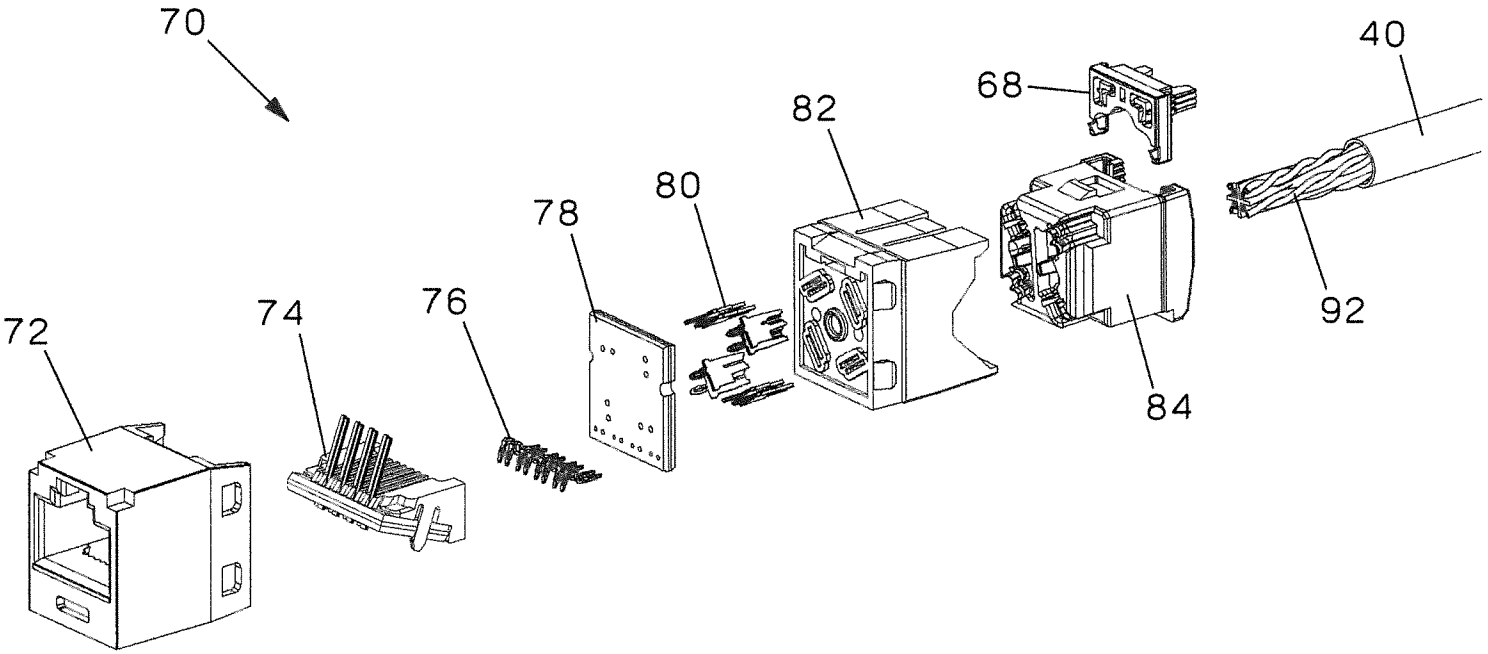
FIG. 2 is an exploded perspective view of an embodiment of a communication jack according to the present invention.

An exploded perspective illustration of a communication jack 70 in accordance with one embodiment of the invention is shown in FIG. 2. Communication jack 70 includes a housing 72 and a nose assembly 74, which makes the electrical connection to plug 36 shown in FIG. 1. Nose assembly 74 connects through board-to-board contacts 76 to a PCB (printed circuit board) 78. PCB 78 includes compensation elements in the form of capacitors and inductors for canceling out or reducing the incident crosstalk caused by plug 36. PCB 78 connects to IDCs 80, which are supported by a rear sled 82. Cable 40 is fed through a wire cap 84 and terminated to jack 70 by way of IDCs 80. Strain relief clip 68 clamps cable 40 to wire cap 84. When cable 40 is properly terminated to jack 70, an electrical communication path is formed from communication wires 92 in cable 40 through IDCs 80, PCB 78, board-to-board contacts 76, and the conductive elements (PCB, plug interface contacts (PTCs), etc.) in nose assembly 74 to contacts in plug 36.

Figure 3:
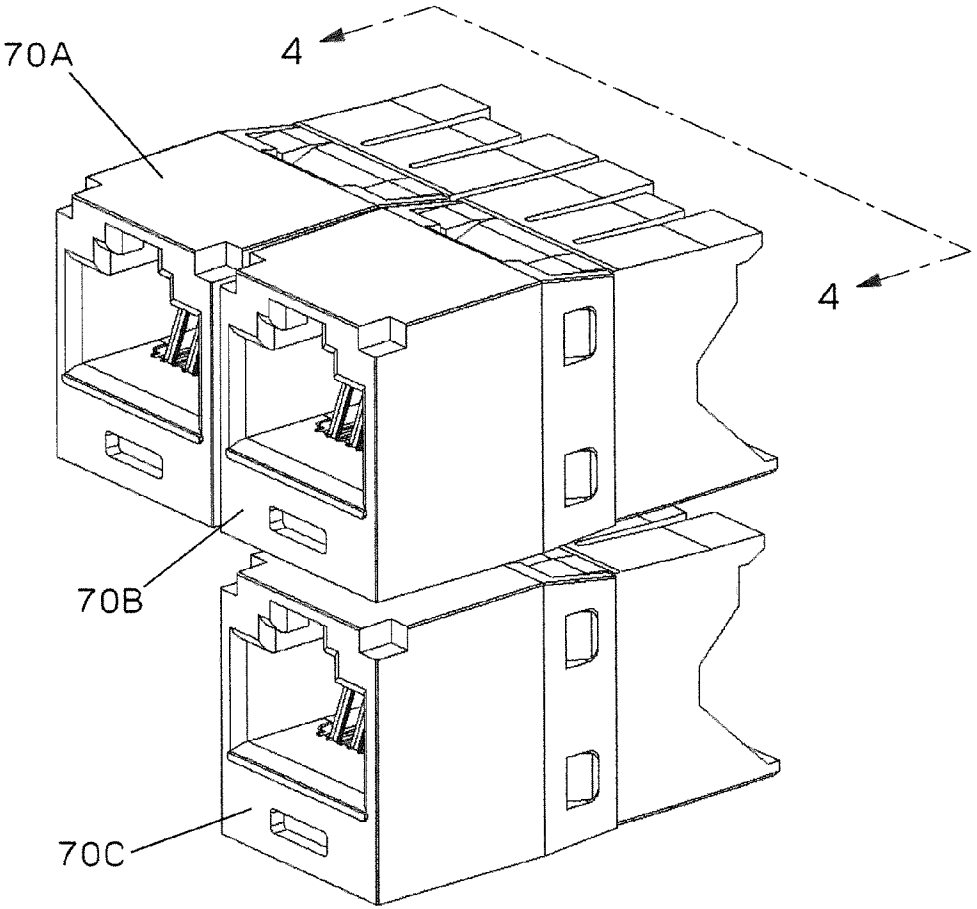
FIG. 3 is a perspective view of three adjacent communication jacks, according to the present invention but minus their respective wire caps, as they might be positioned in a communication system such as the one shown in FIG. 1.
Figure 4:
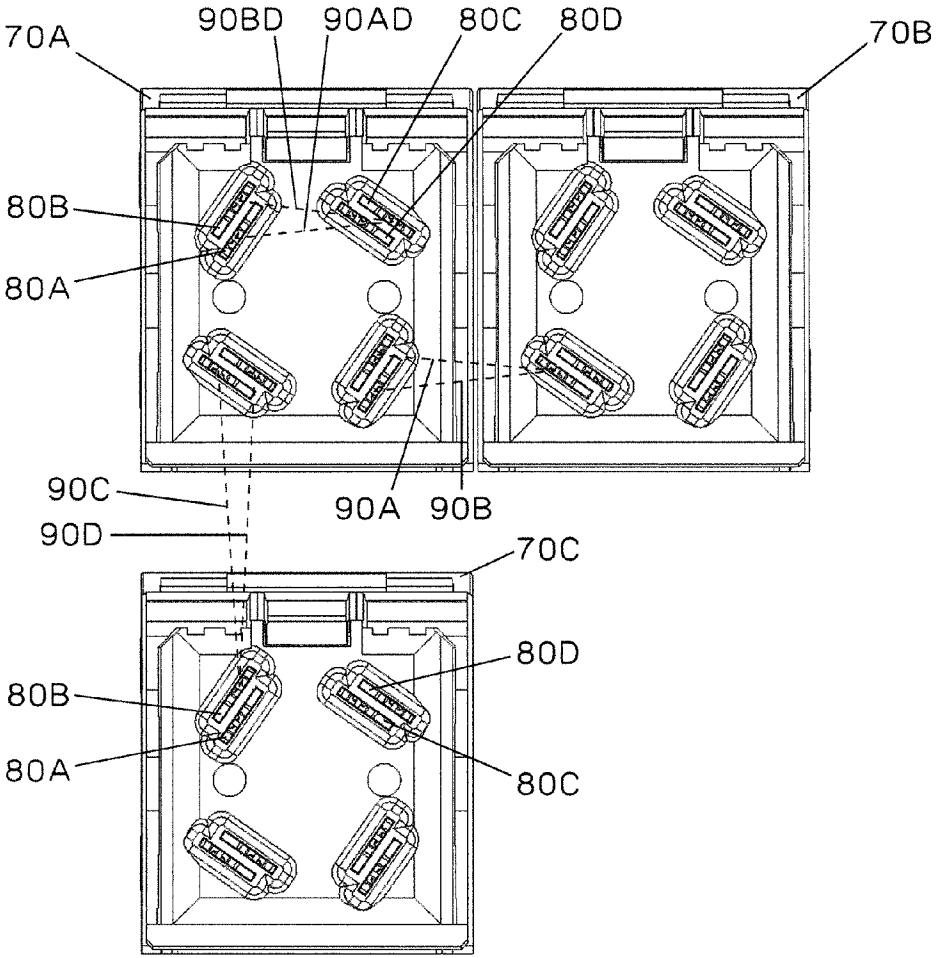
FIG. 4 is a rear view of the three adjacent communication jacks shown in FIG. 3.

FIGS. 3-4 illustrate three assembled jacks 70A-C, without wire caps 84, arranged with jacks 70A-C spaced at a distance approximately equivalent to the separation spacing when installed in patch panel 32 shown in FIG. 1. As shown in FIG. 4, the IDCs are arranged in pairs on each jack 70A-C. For example, IDCs 80A, 80B are arranged to be orthogonal, or approximately orthogonal, to the adjacent pair of IDCs 80C, 80D. This is true of all adjacent pairs (note that the term "adjacent" refers to the IDC pair immediately to the left or right of a particular IDC pair, when tracked around the perimeter of rear sled 82, and does not include the IDC pair diagonally across from the particular IDC pair).

Figure 5:
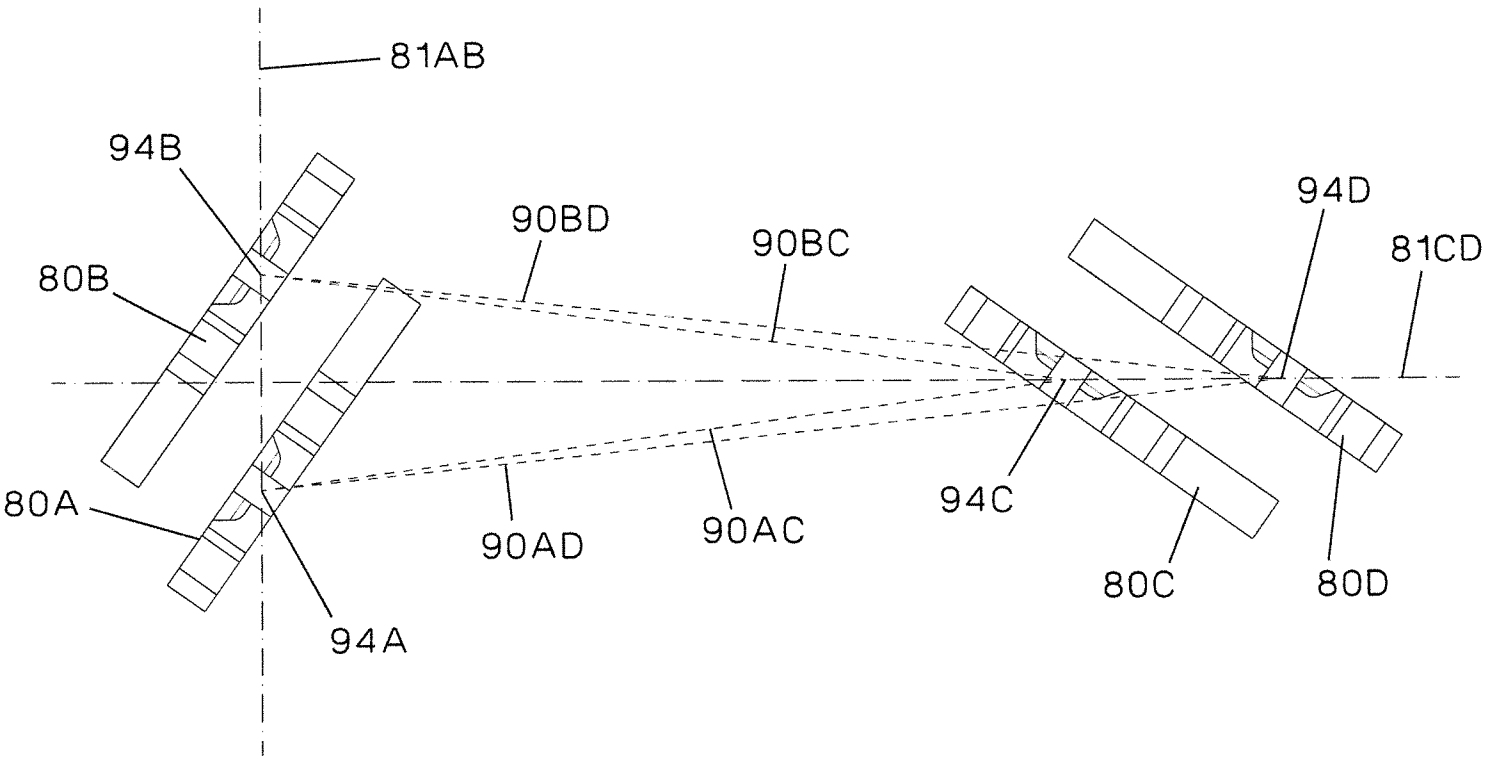
FIG. 5 is a rear view of two IDC pairs for one of the communication jacks shown in FIG. 4.

Each IDC pair has a neighboring IDC pair both horizontally and vertically adjacent within a given jack 70. Thus, for every pair of IDCs, there exists one neighboring pair of IDCs (either vertically or horizontally adjacent) where the distances between a single IDC of the given pair and both IDCs of a neighboring pair are designed to be equivalent. Specifically, as shown in FIGS. 4 and 5, distances 90AD and 90BD are approximately equal, and 90AC and 90BC are approximately equal.

Similarly, as shown in FIG. 4, the distance between neighboring IDCs in adjacent (or other neighboring) jacks 70A-C follows a similar rule. Between vertically and horizontally adjacent IDCs, there exists one pair of IDCs where the distance between the individual IDCs and both IDCs in the neighboring pair is approximately equal. For example, distance 90A is approximately equal to distance 90B, and distance 90C is approximately equal to distance 90D. The relative positioning of the IDCs 80 (i.e. the IDC layout) results in the equal distances between adjacent IDC pairs, as discussed above. To illustrate this concept, FIG. 5 shows IDCs 80A-D. Each IDC 80 includes a conductor termination zone, which can be defined by an approximate center of a termination slot 94A-D formed by a pair of opposing tines 95 (shown in FIG. 7). A pair of such conductor termination zones can define a conductor termination zone centerline. For example, the conductor termination zones of IDCs 80C and 80D define a conductor termination zone centerline 81CD. Similarly, the conductor termination zones of IDCs 80A and 80B define a conductor termination zone centerline 81AB. The conductor termination zone centerline 81CD is a perpendicular bisector of conductor termination zone centerline 81AB. This ensures that the distance 90BC between IDC 80B and IDC 80C is approximately the same as the distance 90AC between IDC 80A and IDC 80C. Similarly distance 90BD is approximately the same as distance 90AD. Having approximately equivalent distances between IDCs 80 promotes balance in the jacks, which assists in canceling or reducing crosstalk effects.

Figure 6:
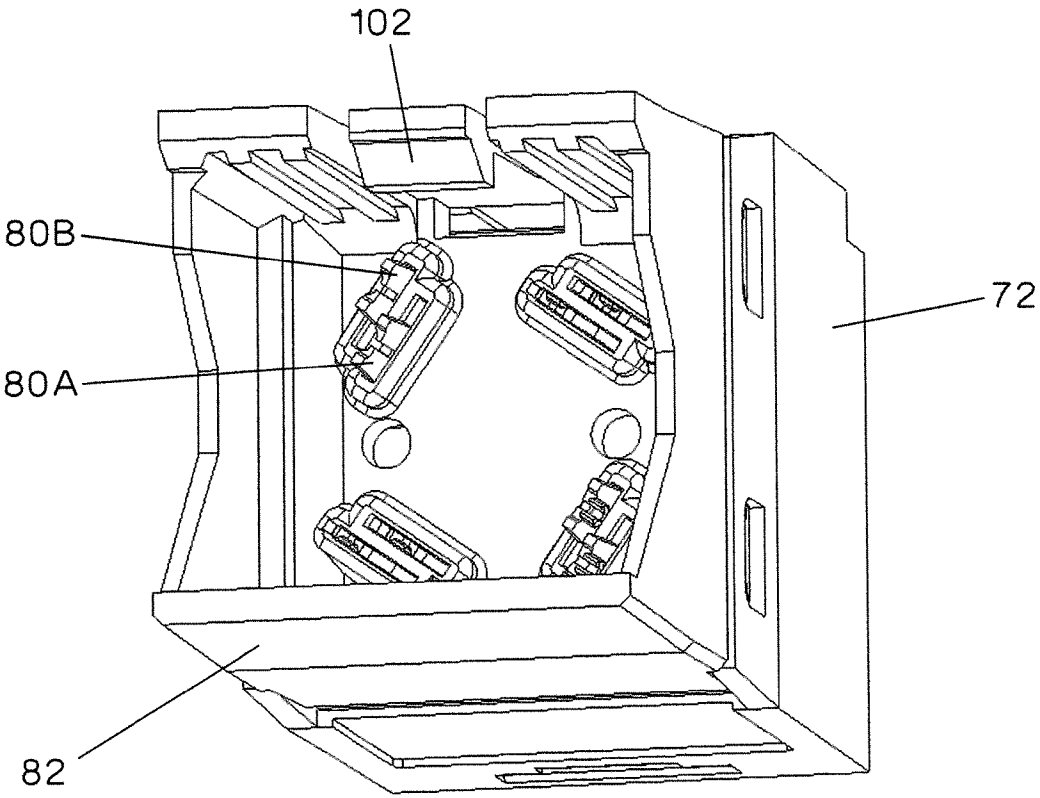
FIG. 6 is a rear perspective view of the IDC layout of one of the communication jacks shown in FIG. 4.
Figure 7:
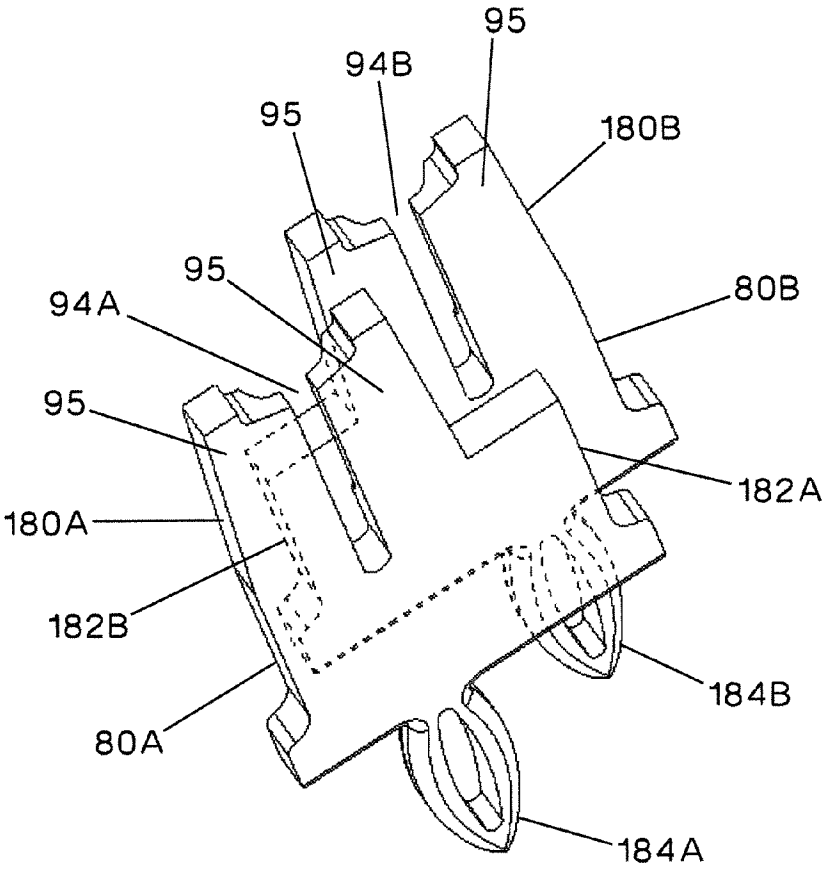
FIG. 7 is a perspective view of one of the IDC pairs in the communication jack in accordance with an embodiment of the present invention.

As shown particularly in FIGS. 6-7, IDCs 80 in the IDC pairs (e.g. 80A-B) are in a staggered formation to each other relative to termination slots 94A and 94B. The staggered formation of the IDC pairs prevents two terminated wires 92 of cable 40 from interfering with each other which could result in a short circuit or inability to terminate cable 40 to jack 70. For example, a wire 92 terminated to IDC 80A passes IDC 80B without interference and vice versa. Described in another way, the associated termination slot centerline for each first contact (e.g. IDC 80) within each contact pair is offset from the associated termination slot centerline for the second contact within that contact pair such that the associated conductor path in the termination slot for the first contact does not interfere with the second contact and the associated conductor path in the termination slot for the second contact does not interfere with the first contact, as illustrated in FIGS. 5 and 7. It is electrically advantageous to keep IDCs 80A and 80B close together as parallel plates to increase capacitance and reduce impedance; however, the staggering of termination slots 94A and 94B allows for the physical connection of conductors 92 to IDCs 80.

As illustrated in FIG. 7, the IDC design includes a relatively narrower upper portion 180A-B (adjacent to respective termination slot 94A-B) and a relatively wider base portion 182A-B. An anchor portion 184 mechanically and electrically connects IDC 80 to PCB 78. Upper portion 180 is offset to one side of base portion 182. In addition to promoting clearance of the terminated communication wires around the other IDC within an IDC pair, this offsetting provides greater capacitive coupling through base portion 182 without increasing (1) the height of IDC 80 or (2) the lateral real estate consumed by the IDC pair. In other words, to achieve the same capacitive area, a symmetric (non-offset) IDC design would require either taller or wider IDCs.

Figure 8:
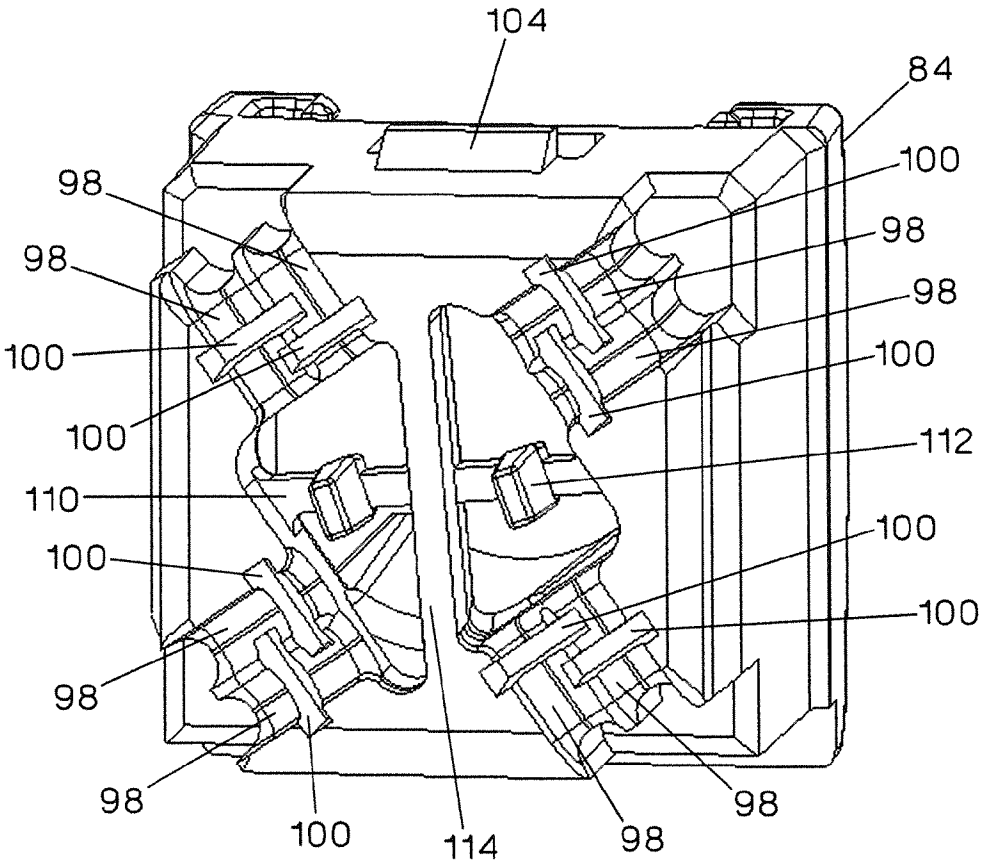
FIGS. 8 and 9 are front and rear perspective views, respectively, of a wire cap in accordance with an embodiment of the present invention.
Figure 9:
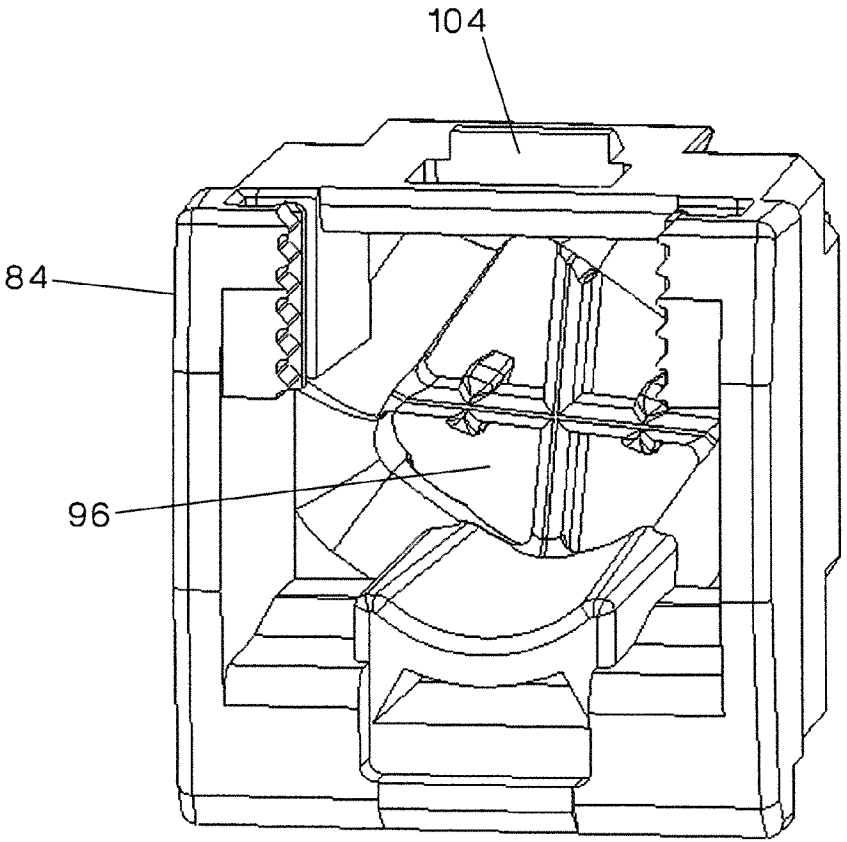

FIGS. 8 and 9 illustrate respective front and rear perspective views of wire cap 84, in accordance with one embodiment. Wire cap 84 houses communication conductor 92 pairs of cable 40 to properly interface with the IDC layout described above and shown in FIGS. 4-6. Wire cap 84 includes locating features 98, 100 for positioning communication conductors 92 within termination slots 94 of IDCs 80. During termination, cable 40 is routed through opening 96. Communication conductors 92 are oriented such that they lay in troughs 98. During assembly of wire cap 84 to rear sled 82, IDCs 80 pierce the insulation of communication conductors 92 and ultimately reside in IDC clearance pockets 100. A latch 102 located on rear sled 82 engages a ramp 104 on wire cap 84 to secure the assembly. Similar to the wire cap described in U.S. Pat. No. 7,452,245, incorporated by reference as if fully set forth herein, wire cap 84 includes support ribs 110, pair separators 112, and spline 114 to provide structure.

Figure 10:
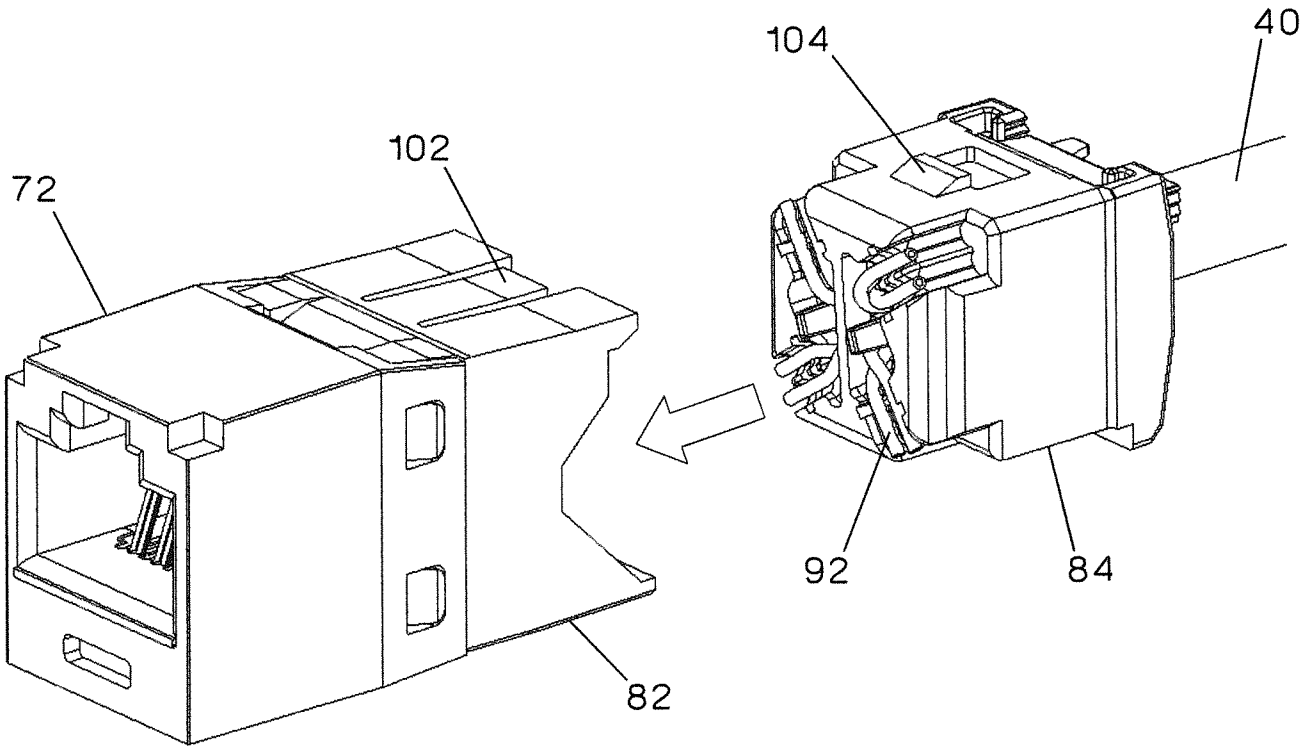
FIG. 10 is a perspective view of a cable terminated to the wire cap of FIGS. 8 and 9, in preparation for assembly to a rear sled of a jack, in accordance with an embodiment of the present invention.
Figure 11:
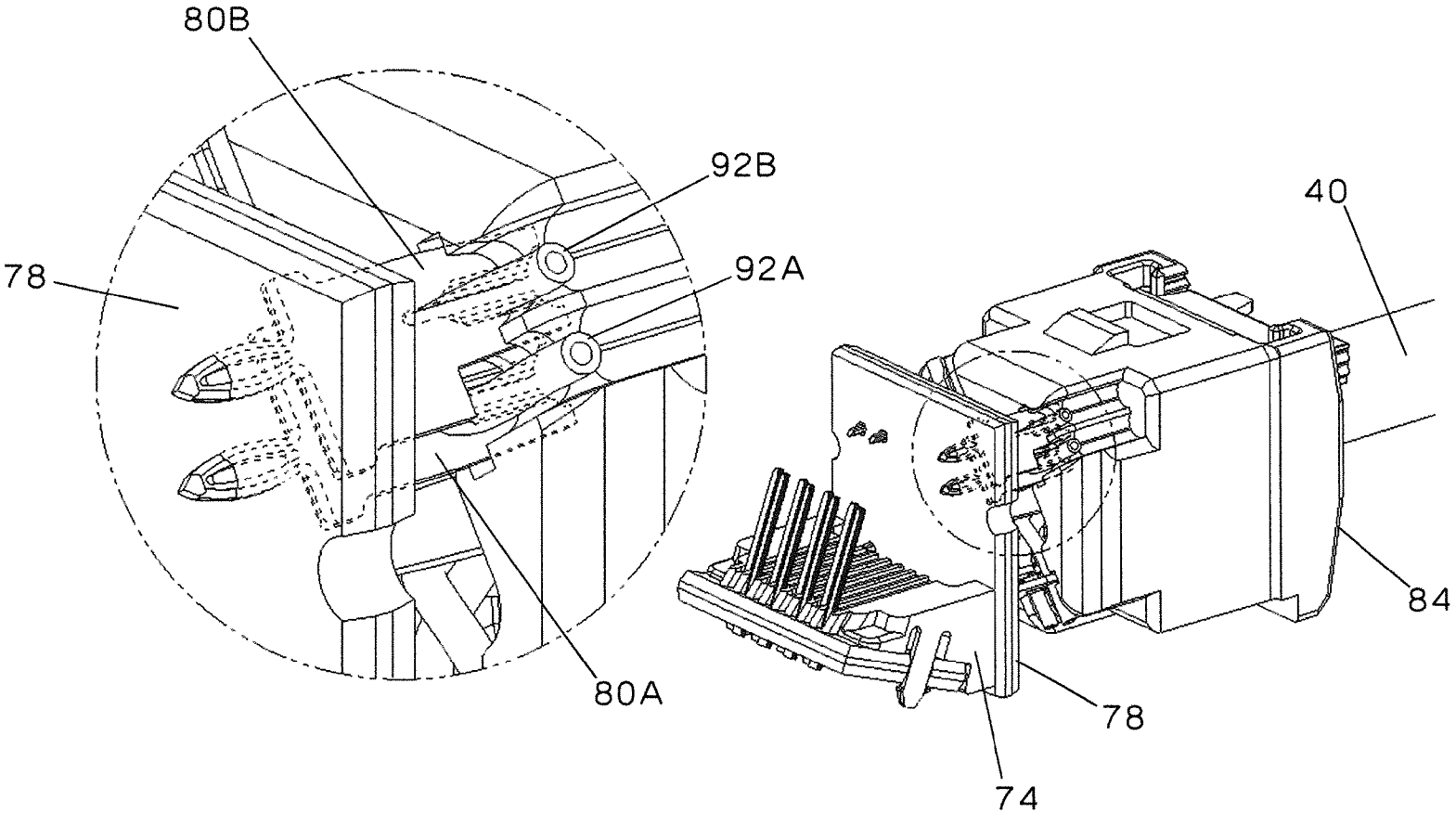
FIG. 11 is a perspective view with cutaway zoom view of a portion of a communication jack in accordance with an embodiment of the present invention.

FIG. 10 shows cable 40 terminated to wire cap 84 in preparation for assembly to rear sled 82. FIG. 11 shows the final assembly of jack 70 terminated to cable 40, with housing 72 and rear sled 82 removed for clarity. The insulation on communication conductors 92A and 92B has been pierced by IDCs 80A and 80B, respectively, making an electrical connection with the underlying conductors of the communication conductors 92A and 92B. Although only one pair of communication conductors 92 is illustrated, the other three (for example) communication conductor pairs of cable 40 preferably make electrical connections to IDCs 80 in an identical manner. The staggered formation of IDCs 80 makes this termination method possible. If termination slots 94A and 948 of IDCs 80A and 808 exactly overlapped, there would be no clearance for communication conductors 92A and 92B.

Figure 12:
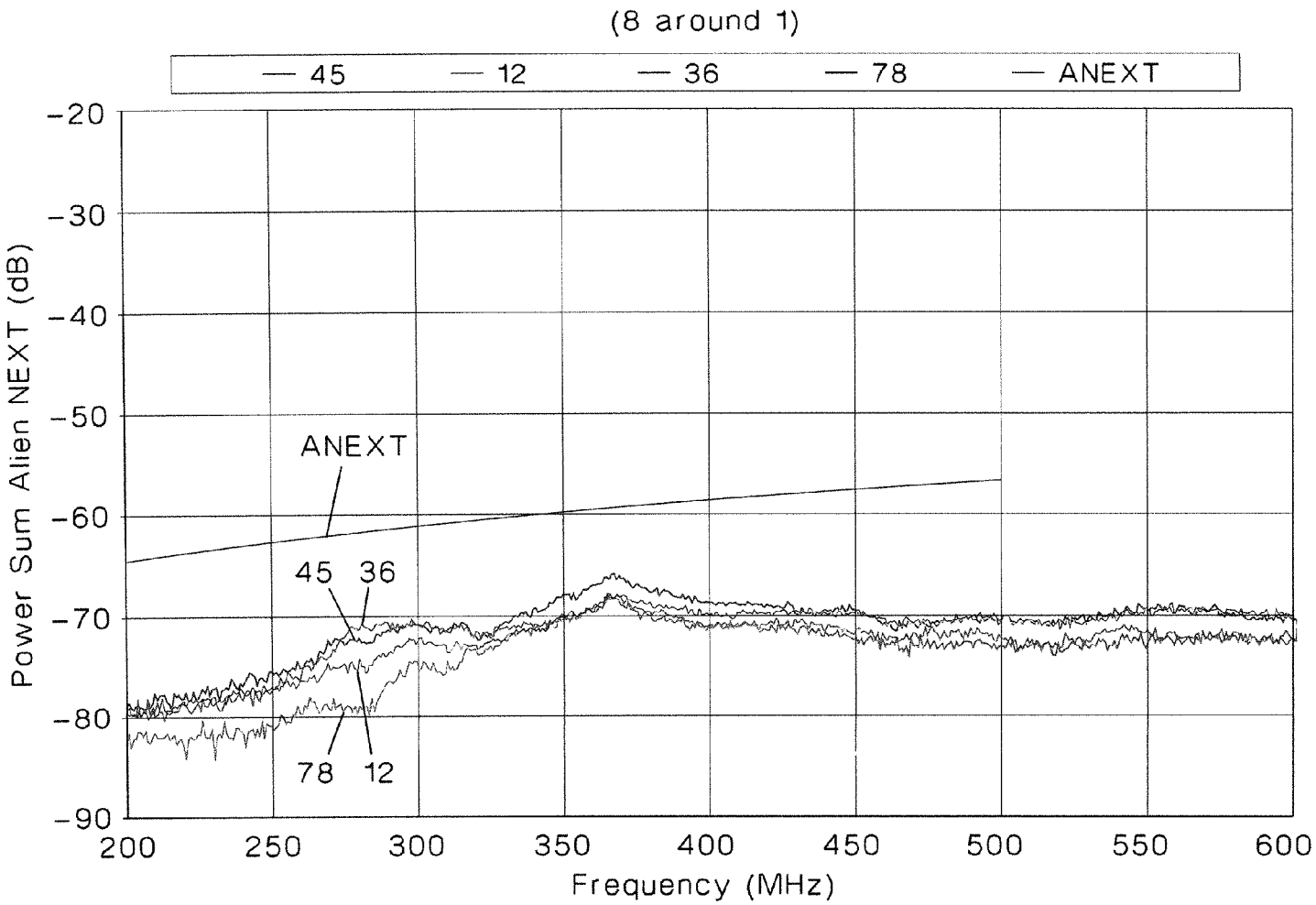
FIG. 12 is a graph showing the 8-around-1 PSANEXT as a function of frequency for the given wire pairs, for the IDC and wire cap shown in FIGS. 4-9.

FIG. 12 is a graph showing the 8-around-1 power-sum alien NEXT (PSANEXT) of IDCs 80 as a function of frequency for particular wire pairs of an embodiment of the present invention. As can be seen there exists approximately 10 dB margin over the connector PSANEXT specification across the entire CAT6A operating frequency spectrum (i.e. 1 to 500 MHz) relative to ANSI/TIA-568-C.2 standard.

In the foregoing descriptions, the communication jack has been illustrated and described as an RJ45 communication jack, such as a CAT6 or CAT6A jack. However, the various embodiments described here are not necessarily limited to such an application, and can be used in any of CAT5E, CAT6, CAT6A, CAT7, CAT7A and other twisted pair Ethernet applications, and other applications such as 40 G and 100 G. Some configurations may be applied in other types of jacks or couplers. Other examples are possible as well.

Communication cables 40 may be unshielded twisted pair (UTP) cables, and more particularly, Category 6A cables that can operate at 10 Gb/s. However, the present invention may be equally applied to or implemented in a variety of communications cables. Examples of possible communications cables include shielded cables, unshielded cables, CAT5E, CAT6, CAT6A, CAT7, CAT7A and other twisted pair Ethernet cables, and others. This list is not meant to be limiting, as other types of cables are possible as well.

Some of the communication cables 40 may be terminated directly into equipment 32, and others may be terminated into communication jacks 34, communication plugs 36, or combinations thereof. Further, communication cables 40 may be processed into looms, or bundles, of cables, and may be processed into preterminated looms.

Communication cables 40 may be used in a variety of structured cabling applications such as patch cords, zone cords, backbone cabling, and horizontal cabling, though embodiments of the present invention are not limited to such applications. In general, the present invention may be used in military, industrial, telecommunications, marine, computer, data communications, and other cabling applications.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A communication connector, comprising:

a housing; and a plurality of contact pairs, said plurality of contact pairs having a first contact pair and a second contact pair, said first contact pair having a first contact with a first conductor termination zone and a second contact with a second conductor termination zone, said first conductor termination zone and said second conductor termination zone being staggered with respect to each other and defining a first conductor termination zone centerline, said second contact pair having a third contact with a third conductor termination zone and a fourth contact with a fourth conductor termination zone, said third conductor termination zone and said fourth conductor termination zone being staggered with respect to each other and defining a second conductor termination zone centerline, wherein said second conductor termination zone centerline is an approximately perpendicular bisector of said first conductor termination zone centerline.

2. The communication connector of claim 1, wherein at least one of said first contact, said second contact, said third contact, and said fourth contact is an insulation displacement contact.

3. The communication connector of claim 2, wherein at least one of said insulation displacement contacts includes an upper portion having an upper portion center, and a lower portion having a lower portion center, said lower portion being wider than said upper portion, said lower portion center being offset from said upper portion center.

4. The communication connector of claim 1, wherein at least one of said first conductor termination zone, said second conductor termination zone, said third conductor termination zone, and said fourth conductor termination zone is defined by an approximate center of a termination slot.

5. The communication connector of claim 1, wherein said first contact is parallel to said second contact.

6. The communication connector of claim 5, wherein said third contact is parallel to said fourth contact.

7. The communication connector of claim 1, wherein said housing includes a plug receiving aperture.

8. The communication connector of claim 1, wherein said first contact has an approximately equal first distance to said third contact and said fourth contact, and said second contact has an approximately equal second distance to said third contact and said fourth contact.

9. A communication system, comprising:

a communication equipment; and a communication connector connected to said communication equipment, said communication connector including a housing and a plurality of contact pairs, said plurality of contact pairs having a first contact pair and a second contact pair, said first contact pair having a first contact with a first conductor termination zone and a second contact with a second conductor termination zone, said first conductor termination zone and said second conductor termination zone being staggered with respect to each other and defining a first conductor termination zone centerline, said second contact pair having a third contact with a third conductor termination zone and a fourth contact with a fourth conductor termination zone, said third conductor termination zone and said fourth conductor termination zone being staggered with respect to each other and defining a second conductor termination zone centerline, wherein said second conductor termination zone centerline is an approximately perpendicular bisector of said first conductor termination zone centerline.

10. The communication system of claim 9, wherein at least one of said first contact, said second contact, said third contact, and said fourth contact is an insulation displacement contact.

11. The communication system of claim 10, wherein at least one of said insulation displacement contacts includes an upper portion having an upper portion center, and a lower portion having a lower portion center, said lower portion being wider than said upper portion, said lower portion center being offset from said upper portion center.

12. The communication system of claim 9, wherein at least one of said first conductor termination zone, said second conductor termination zone, said third conductor termination zone, and said fourth conductor termination zone is defined by an approximate center of a termination slot.

13. The communication system of claim 9, wherein said first contact is parallel to said second contact.

14. The communication system of claim 13, wherein said third contact is parallel to said fourth contact.

15. The communication system of claim 9, wherein said housing includes a plug receiving aperture.

16. The communication system of claim 9, wherein said first contact has an approximately equal first distance to said third contact and said fourth contact, and said second contact has an approximately equal second distance to said third contact and said fourth contact.

17. A communication connector, comprising:

a housing; and a plurality of contact pairs arranged relative to said housing, at least one of said plurality of contact pairs including a first insulation displacement contact with a first conductor termination zone and a second insulation displacement contact with a second conductor termination zone, said first conductor termination zone offset from said second conductor termination zone to provide clearance for conductors to be normally terminated in the first and second insulation displacement contact, said first insulation displacement contact and said second insulation displacement contact configured for approximately maintaining a predetermined impedance, wherein said wire cap positions said conductors relative to the first and second insulation displacement contact such that said conductors are normally terminated in the first and second insulation displacement contact.

18. The connector of claim 17, wherein said impedance is maintained by optimizing an overlapping surface area of said first insulation displacement contact and said second insulation displacement contact.

19. The connector of claim 18, wherein said overlapping surface area is arranged to allow first and second conductors to be respectively terminated in said first conductor termination zone and said second conductor termination zone.

20. A communication connector for interfacing with a communication cable having a plurality of communication wires arranged in communication wire pairs, the communication connector comprising:

a plurality of contact pairs, each of said plurality of contact pairs comprising a first generally planar contact having a first termination slot for terminating a corresponding one of the communication wires and a second generally planar contact having a second generally planar slot for terminating a corresponding another one of the communication wires, wherein the first termination slot and the second termination slot are staggered with respect to each other, and wherein for each contact pair within the connector, there exists an adjacent contact pair within the connector in which the termination slots of the contacts in the adjacent contact pair are equidistant from the termination slot of at least one of the contacts in the contact pair.

21. A method of connecting a twisted pair conductor communication cable to a communication jack, said method comprising the steps of:

providing a communication jack having a housing and a plurality of contact pairs;

positioning one of said plurality of contact pairs which defines a first conductor termination zone centerline, and another of said plurality of contact pairs which defines a second conductor termination zone centerline, wherein said one of said plurality of contact pairs includes a first pair of contacts which are staggered with respect to each other and said another of said plurality of contact pairs includes a second pair of contacts which are staggered with respect to each other, and wherein said second conductor termination zone centerline is an approximately perpendicular bisector of said first conductor termination zone centerline; and terminating the conductors of the twisted pair communication cable to respective said plurality of contact pairs.

22. A method of connecting a communication cable to a communication jack, wherein the communication cable has a plurality of communication wire pairs and wherein the communication jack has a housing and a plurality of contact pairs, said method comprising the steps of:

arranging the contact pairs relative to the housing so that contacts of each respective pair are staggered with respect to one another, and so that each contact pair is adjacent to another contact pair in which at least one of the contacts in the contact pair is equi-distant to both contacts in the adjacent contact pair;

positioning the communication cable in the housing so that each of the plurality of communication wire pairs is associated with a corresponding one of each of the plurality of contact pairs; and terminating the communication wire pairs in the contact pairs.

* * * * *